US008978776B2

(12) United States Patent
Spray

(10) Patent No.: US 8,978,776 B2
(45) Date of Patent: Mar. 17, 2015

(54) POROUS TUBULAR STRUCTURES AND A METHOD FOR EXPANDING POROUS TUBULAR STRUCTURES

(75) Inventor: Jeffery A. Spray, Houston, TX (US)

(73) Assignee: Dynamic Tubular Systems, Inc., Houston, TX (US)

( * ) Notice: Subject to any disclaimer, the term of this patent is extended or adjusted under 35 U.S.C. 154(b) by 558 days.

(21) Appl. No.: 12/596,411

(22) PCT Filed: Apr. 17, 2008

(86) PCT No.: PCT/US2008/060651

§ 371 (c)(1),
(2), (4) Date: Jan. 14, 2010

(87) PCT Pub. No.: WO2009/009190

PCT Pub. Date: Jan. 15, 2009

(65) Prior Publication Data

US 2010/0116495 A1 May 13, 2010

Related U.S. Application Data

(60) Provisional application No. 60/925,320, filed on Apr. 18, 2007.

(51) Int. Cl.
*E21B 23/00* (2006.01)
*E21B 43/10* (2006.01)

(52) U.S. Cl.
CPC ..... *E21B 43/108* (2013.01)
USPC ..... 166/381; 166/207; 166/214; 29/525.14

(58) Field of Classification Search
USPC ..... 166/381, 206, 207, 214, 234; 29/525.14
See application file for complete search history.

(56) References Cited

U.S. PATENT DOCUMENTS

| | | | | |
|---|---|---|---|---|
| 1,620,412 | A * | 3/1927 | Tweeddale | 166/203 |
| 6,772,836 | B2 | 8/2004 | Schetky et al. | |
| 6,904,974 | B2 | 6/2005 | Slack | |
| 7,048,048 | B2 | 5/2006 | Nguyen et al. | |
| 2002/0107562 | A1 * | 8/2002 | Hart et al. | 623/1.15 |
| 2002/0189808 | A1 * | 12/2002 | Nguyen et al. | 166/278 |
| 2003/0062170 | A1 * | 4/2003 | Slack | 166/377 |
| 2005/0109517 | A1 | 5/2005 | Spray | |
| 2006/0037745 | A1 * | 2/2006 | Hart et al. | 166/242.1 |
| 2010/0038076 | A1 * | 2/2010 | Spray et al. | 166/207 |

OTHER PUBLICATIONS

International Search Report for PCT/US2008/060651 mailed Jun. 12, 2009 (3 pages).
Written Opinion of ISA for PCT/US2008/060651 mailed Jun. 12, 2009 (4 pages).

(Continued)

*Primary Examiner* — Catherine Loikith
(74) *Attorney, Agent, or Firm* — Osha Liang LLP

(57) ABSTRACT

An expandable tubular to be used within geologic structures and a method of manufacturing thereof has a substantially tubular shaped member with an axis extending therethrough. The tubular member has one or more helical member formed within a wall of the tubular member, and the helical member may be defined about the axis of the tubular shaped member. Further, a plurality of elongated perforations are formed within the wall of tubular member, and the tubular member is compressible from a larger diameter to a smaller diameter. When compressed, the tubular member stores expansive energy within the wall, in which the tubular member may then expand back to a larger diameter when the expansive energy is released.

31 Claims, 6 Drawing Sheets

(56) References Cited

OTHER PUBLICATIONS

International Preliminary Report on Patentability with transmittal letter issued in corresponding International Appln. No. PCT/US2008/060651, mailed on Oct. 29, 2009, 6 pages.
Gulf Cooperation Council Examination Report issued in Application No. GCC/P/2008/10627 dated Dec. 20, 2011 (3 pages).
Gulf Cooperation Council Examination Report issued in Application No. GCC/P/2008/10627 dated May 30, 2011, 3 pages.
Chinese Office Action issued in the corresponding Chinese application No. 200880020608.3, mailing date Jun. 11, 2012, with English translation thereof (18 pages).
Office Action for Chinese Application No. 200880020608.3 dated Feb. 22, 2013, with English translation thereof (12 pages).

* cited by examiner

POROUS TUBULAR STRUCTURES AND A METHOD FOR EXPANDING POROUS TUBULAR STRUCTURES

CROSS-REFERENCE TO RELATED APPLICATIONS

This application, pursuant to 35 U.S.C. §119(e), claims priority to U.S. Patent Application Ser. No. 60/925,320 filed on Apr. 18, 2007 and entitled "Porous Tubular Structures" in the name of Jeffery A. Spray, which is hereby incorporated by reference in its entirety.

STATEMENT REGARDING FEDERALLY SPONSORED RESEARCH OR DEVELOPMENT

This invention was made with United States Government support under DOE Cooperative Agreement No. DE-FC26-05NT15491 awarded by DOE. The United States Government has certain rights in this invention.

BACKGROUND

1. Field of the Disclosure

Embodiments disclosed herein generally relate to expandable tubulars. More specifically, embodiments disclosed herein relate to an improved porous expandable tubular that is used within geologic structures, such as when drilling, completing, and producing a well.

2. Background Art

When drilling a well, such as an oil, water, and/or gas (i.e., fluid) producing well, the well may have to be formed within an unconsolidated formation. This unconsolidated formation may contain particulate matter, such as sand, in which the sand often is produced along with the fluid in the well. The sand and particulate matter produced may cause excessive wear or abrasion within the equipment (e.g., tubing, valves, pumps) used to produce the fluids within the well. For example, sand flowing through a valve of the production equipment may cause the valve to lose sealing capabilities, such as by having sand become trapped within the valve, or by having the sand abrade the seals within the valve. Therefore, it is beneficial to prevent, or to at least minimize, the production of sand, or any other particulate matter, when producing fluids in a well.

A common method used to minimize the production of particulate matter and filter out sand is by "gravel packing" the fluid producing well, such as during the completions operation of the well. When gravel packing a well, a steel screen, commonly known as a well screen, is placed within the wellbore. The annulus surrounding the screen is then packed with prepared gravel designed to prevent the passage of sand. The size of the gravel is usually the controlling design feature that prevents the passage of sand into the interior of the well screen, in which the gravel is usually larger than the sand found within the formation. For example, as shown in FIG. 1, a wellbore 100 with a gravel pack packer 102 is shown. The gravel pack packer 102 may be set in a casing 104 with a gravel pack screen 106 (i.e., well screen) placed within a perforated zone 108 of the gravel pack 102. Gravel 110 is then placed in the casing 104 and may flow into perforations 108 of the casing 104, in which the gravel 110 may minimize or eliminate sand production. Though this method is still commonly used, the gravel packing method may take up considerable area within the wellbore.

Other technology has also been developed to make it possible to expand a tubular when downhole, thereby attempting to minimize the area needed for sand control. This technology enables a tubular of a smaller diameter to be inserted downhole into a wellbore and then be expanded to a larger diameter once in place. This technique has been incorporated into tubular members, such as well screens and sand screens, to permit the passage of production fluid therethrough, but still inhibit the passage of particulate matter.

In one example, an expandable sand screen may be inserted downhole into a wellbore at the end of a string of tubulars. The initial outer diameter of this expandable sand screen may be smaller than the inner diameter of the wellbore. A wedge-shaped cone, also commonly referred to as a mandrel, is also inserted downhole with the sand screen on a separate string of tubulars, thereby having the cone moving independently of the sand screen. When the screen is then fixed within the wellbore at the proper location, the cone is urged into and through the sand screen with the tapered surface end of the cone preferably entering the sand screen tubular first. This urging of the cone through the sand screen tubular plastically expands the inner diameter of the sand screen to that generally of the outer diameter of the cone.

This type of expandable screen is useful in wells to increase proximity of the sand screen to the producing interface downhole. However, the requirement of an expansion cone to expand the tubular adds steps to the completion of a well by requiring at least one additional trip downhole with the cone attached to a string of tubulars. As such, these additional steps may be time consuming when using expandable sand screens. Further, this type of expandable screen may be limited to only certain types of environments and usages, as the expansion ratio, particle size retention, flexible formation contact, and collapse rating characteristics of these expandable screens may be limited. The current industry standard for the expansion ratio is generally 115%-150%, for the particle size retention is 140-300 microns (0.0055-0.012 inches), for the flexible formation contact 0-100 psi (0–690 kPa), and for the collapse rating is 270-1200 psi (1,860–8,270 kPa). As such, these current standards may be limited to meet the expectations of current and developing user needs. Accordingly, there exists a need for an expandable screen that improves upon these prior art screens for continued development and success within the fluid production industries.

SUMMARY OF THE DISCLOSURE

In one aspect, embodiments disclosed herein relate to an expandable tubular to be used within geologic structures. The expandable tubular includes a substantially tubular shaped member having an axis extending therethrough, at least one helical member formed within a wall and defined about the axis of the tubular shaped member, and a plurality of elongated perforations formed within the wall of the tubular shaped member. The tubular shaped member is configured to be compressed and store expansive energy within the wall of the tubular shaped member.

In another aspect, embodiments disclosed herein relate to an expandable tubular to be used within geologic structures. The expandable tubular includes a substantially tubular shaped member having an axis extending therethrough, in which the tubular shaped member includes a plurality of elongated members disposed parallel with respect to the axis of the tubular shaped member and at least one helical member formed within a wall of the substantially tubular member. Each of the plurality of elongated members are attached to the at least one helical member such that a plurality of elongated perforations are formed between the plurality of elongated members, and a first elongated member of the plurality of elongated members is disposed on one side of the helical member, a second elongated member of the plurality of elongated members is disposed on the other side of the helical member, and the first and second elongated members are in alignment with respect to each other. Further, the tubular shaped member is configured to be compressed and store expansive energy within the plurality of elongated members of the tubular shaped member.

In yet another aspect, embodiments disclosed herein relate to a method of expanding a tubular shaped member. The method includes providing the tubular shaped member having a first diameter, wherein at least one helical member is formed within a wall of the tubular shaped member and is defined about a longitudinal axis thereof, in which a plurality of elongated perforations are formed within the wall of the tubular shaped member. The method further includes compressing the tubular shaped member to a second diameter that is smaller than the first diameter such that expansive energy is stored within the wall of the tubular shaped member.

Further, in yet another aspect, embodiments disclosed herein relate to a method of manufacturing an expandable tubular to be used within geologic structures. The method includes providing a plurality of elongated members and attaching the plurality of elongated members to each other such that the plurality of elongated members form a substantially tubular shaped member having an axis extending therethrough. The attachment of the plurality of elongated members to each other forms a plurality of elongated perforations between the plurality of elongated members, and the attachment of the plurality of elongated members to each other forms a plurality of helical members within a wall and defined about the axis of the tubular shaped member.

Other aspects and advantages of the present disclosure will be apparent from the following description and the appended claims.

DETAILED DESCRIPTION

Figure 1:
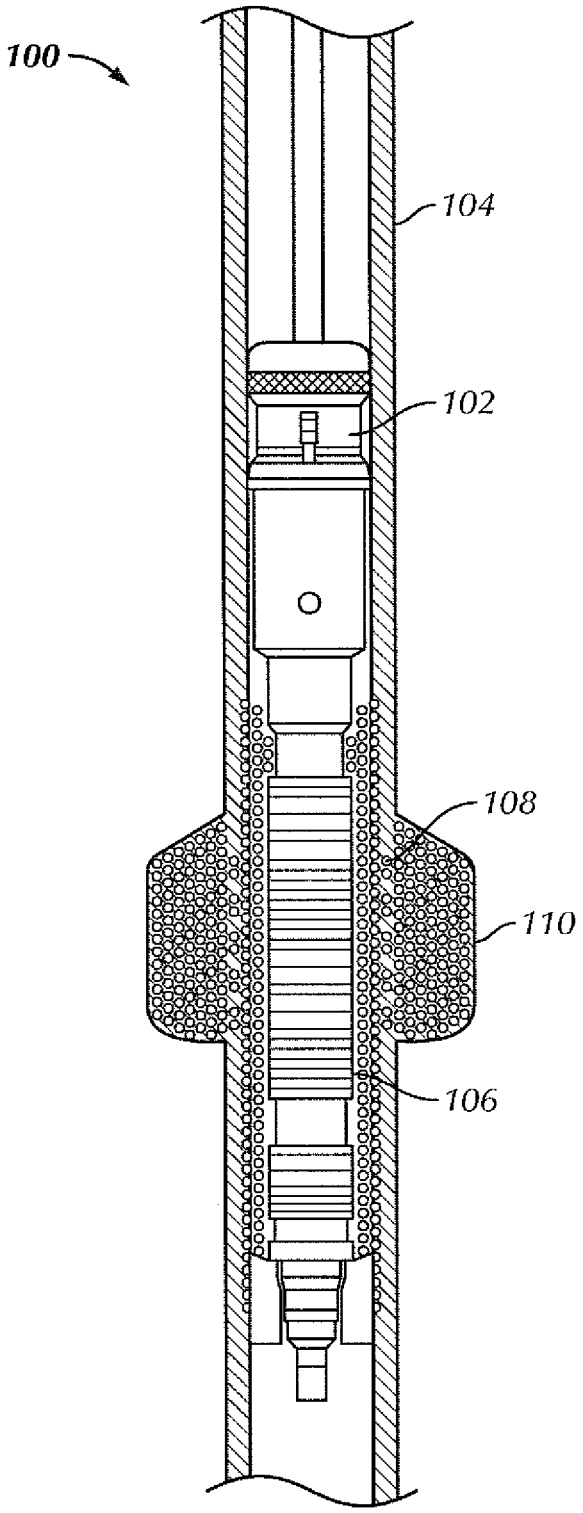
FIG. 1 (Prior Art)
FIG. 1 shows a perspective view of a prior art gravel packer.

Specific embodiments of the present disclosure will now be described in detail with reference to the accompanying figures. Like elements in the various figures may be denoted by like reference numerals for consistency. Further, in the following detailed description of embodiments of the present disclosure, numerous specific details are set forth in order to provide a more thorough understanding of the invention. However, it will be apparent to one of ordinary skill in the art that the embodiments disclosed herein may be practiced without these specific details. In other instances, well-known features have not been described in detail to avoid unnecessarily complicating the description.

In one aspect, embodiments disclosed herein generally relate to an expandable tubular to be used within geologic structures. The expandable tubular has a substantially tubular shaped member with an axis extending therethrough. The tubular member has one or more helical members formed within a wall of the tubular member, and the helical member is defined about the axis of the tubular shaped member. Further, a plurality of elongated perforations are formed within the wall of the tubular member, and the tubular member is compressible from a larger diameter to a smaller diameter. When compressed, the tubular member stores expansive energy within the wall, in which the tubular member may then expand back to a larger diameter when the tubular member is placed downhole within a wellbore. Furthermore, the tubular member may be formed, or include, a plurality of elongated members. The plurality of elongated members are attached to each other at the ends such that the plurality of elongated perforations are formed between the plurality of elongated members.

As described herein, the present disclosure may be used within the production of hydrocarbons, such as oil and gas. For example, the present disclosure may be used within expandable tubulars that include, but are not limited to, sand screens, porous liners, isolation sleeves, "convertible" (e.g., composite) solid-to-porous tubulars, rock support tubulars, borehole support tubulars used to retain lost circulation materials, cement or other materials, and any other downhole tubulars and tools known in the art. However, the present disclosure may also be used within similar wells and structures, such as water wells, dewatering wells, monitoring and remediation wells, tunnels, shafts, pipelines, and other similarly known tubular applications. Further, the present disclosure is related to tubular members. As used herein, "tubular" refers to any structure that may be generally round, generally oval, or even generally elliptical. Accordingly, these structures may be incorporated into the embodiments disclosed herein.

Figure 2:
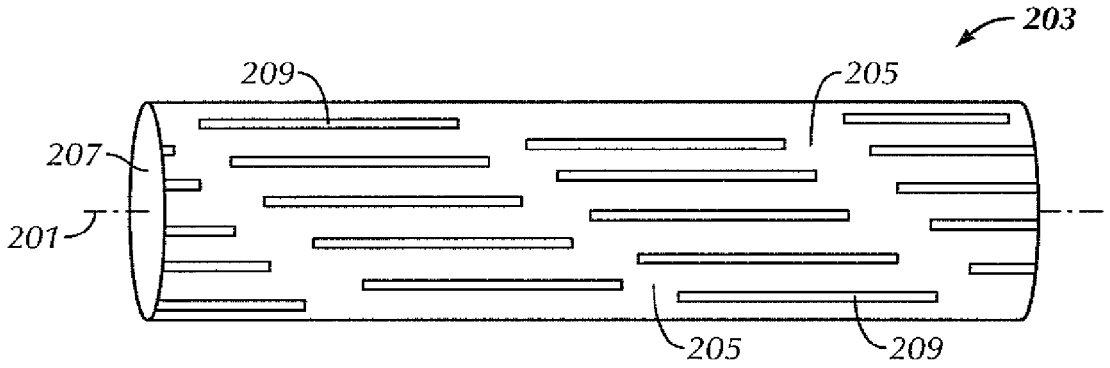
FIG. 2 shows a side view of a tubular member in accordance with embodiments of the present disclosure.

Referring now to FIG. 2, a side view of a tubular member 203 in accordance with embodiments of the present disclosure is shown. The tubular member 203 has an axis 201 extending therethrough and includes one or more helical members 205. The helical members 205 are formed within a wall 207 of the tubular member 203, and the helical members 205 are defined about the axis 201 of the tubular member 203. Accordingly, the helical members 205 may form a spiral about the diameter of the tubular member 203, such as form a spiral about the axis 201 of the tubular member 203.

The tubular member 203 further includes a plurality of elongated perforations 209 formed therein, specifically within the wall 207 of the tubular member 203. These elongated perforations 209 enable the tubular member 203 to be porous. Thus, the elongated perforations 209 are large enough such as to enable desired gases and liquids to pass through the wall 207 of the tubular member 203, but small enough such as to inhibit and prevent undesired particulate matter, such as sand, from passing through the wall 207 of the tubular member 203. Further, the tubular member 203 may be compressed from a larger diameter to a smaller diameter, in which the tubular member 203 stores expansive energy within the wall 207 when compressed. The elongated perforations 209 enable the tubular member 203 to be porous, regardless if the tubular member 203 is in a compressed or expanded state.

In accordance with one embodiment of the present disclosure, a solid tubular member, such as a solid metal pipe, having no perforations formed therein is obtained. Then, using this solid tubular, the tubular member 203 may be formed with the elongated perforations 209 using a variety of methods. For example, a thin cutting blade or beam may be used to form the elongated perforations 209. Alternatively, a laser-type, water-abrasive type, or an electrical discharge machining ("EDM") cutting tool may be used to form the elongated perforations 209. Regardless, the elongated perforations 209 are, preferably, fairly narrow, such as about 0.002-0.250 inches (0.051-6.35 millimeters) in width at the largest portion of the elongated perforations 209. As such, those having ordinary skill in the art will appreciate that this size of the elongated perforations 209 may vary depending on the size of the particulate matter that is being screened by the tubular member. The tubular member 203 may include hundreds, or possibly even thousands, of elongated perforations 209 formed therein.

As shown in FIG. 2, the elongated perforations 209 have a generally rectangular shape. However, those having ordinary skill in the art will appreciate that the present disclosure is not so limited. The elongated perforations may also have an elliptical shape, trapezoidal shape, rhomboid shape, convex or concave shape, or any other shape known in the art. The elongated perforations 209 are also shown in FIG. 2 as having generally the same size. Those having ordinary skill in the art, though, will appreciate that the present disclosure is also not so limited, as the sizes may vary amongst the elongated perforations.

Figure 3A:
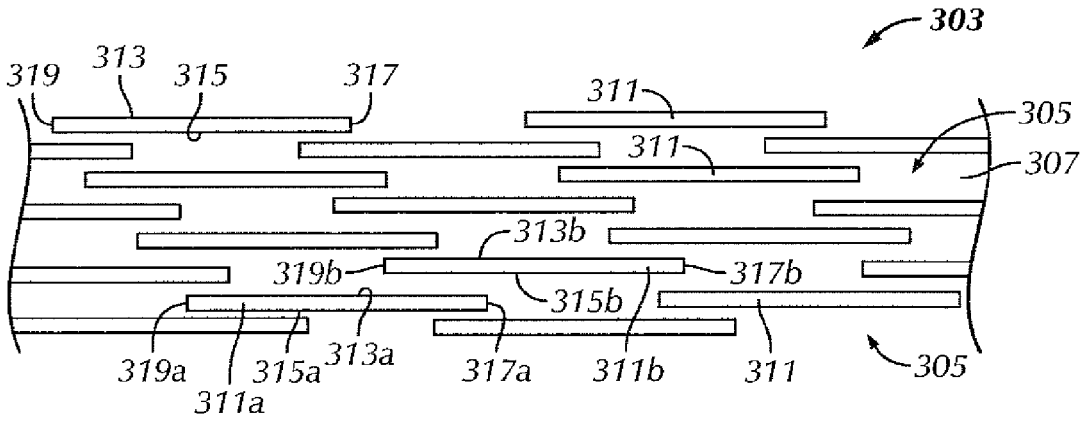
FIG. 3A shows a detail view of a tubular member in accordance with embodiments of the present disclosure.
Figure 3B:
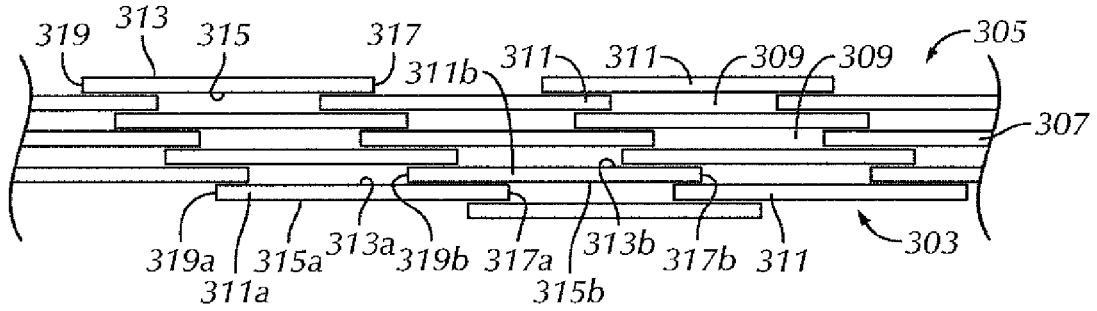
FIG. 3B shows a detail view of the tubular member shown in FIG. 3A in accordance with embodiments of the present disclosure.

Referring now to FIGS. 3A and 3B, detail views of a wall 307 of a tubular member 303 in accordance with embodiments disclosed herein are shown. In this embodiment, rather than forming the tubular member 303 from an originally solid tubular, the tubular member 303 is formed from a plurality of elongated members 311 (e.g., strainers). In FIG. 3A, an exploded view of the elongated members 311 of the tubular member 303 is shown. In FIG. 3B then, a perspective view of the elongated members 311 of the tubular member 303 is shown.

The elongated members 311 may include two sides 313, 315 and two ends 317, 319. To form the wall 307 of the tubular member 303, the elongated members 311 may be attached to each other at the ends 317, 319, such as in a staggered manner. Specifically, when attaching the elongated members 311 to each other, one side 313A adjacent to one end 317A of one elongated member 311A may be attached to one side 315B adjacent to one end 319B of another elongated member 311B. Thus, when attaching the elongated members 311 to each other, the elongated members 311 may have elongated perforations 309 formed therebetween. Further, by attaching the elongated members 311 to each other in this manner, the tubular member 303 also has helical members 305 formed within the wall 307.

The elongated members 311 may be attached to each other using a variety of methods, such as by using a joining process, an adhesive material (e.g., elastomer adhesive), or any other method or material known in the art (described more below). The portions of the elongated members 311 that attach to each other may then form the helical members 305 that are defined about the axis of the tubular member 303.

After the elongated members 311 are attached to each other, the tubular member 303 may be plated or coated to enhance the mechanical features of the tubular member 303. For example, the tubular member 303 may be plated or coated to increase the strength of the attachments between the elongated members 311, to increase the strength of the elongated members 311 individually, to increase corrosion resistivity of the tubular member 303, to improve the surface-flow across the tubular member 303 (such as enabling fluids and gases to more easily flow across the surface and through the wall 307 of the tubular member 303), and/or to eliminate or decrease any manufacturing defects of the tubular member 303 (such as by regulating the size of any over-sized or under-sized elongated members 311 or straightening any elongated members 303 that may have been deformed during manufacturing).

Figure 4:
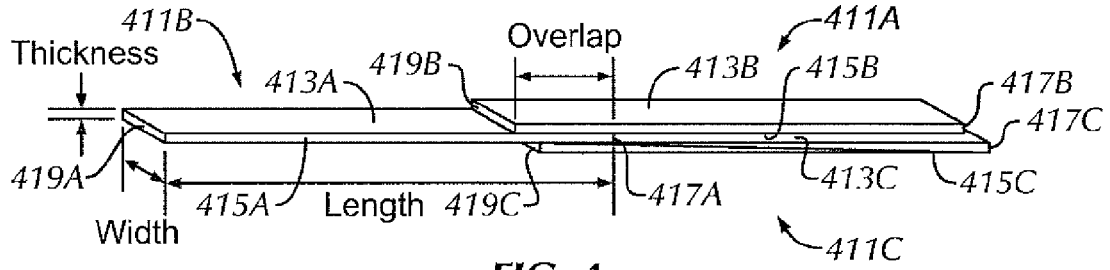
FIG. 4 shows a detail view of a plurality of elongated members in accordance with embodiments of the present disclosure.

Referring now to FIG. 4, a perspective view of three elongated members 411A-C in accordance with embodiments disclosed herein is shown. As similar to above, the elongated members 411A-C each have two sides 413A-C, 415A-C and two ends 417A-C, 419A-C, in which the elongated members 411A-C are attached to each other. Specifically, in this embodiment, the side 413A adjacent to the end 417A of the elongated member 411A is attached to the side 415B adjacent to the end 419B of the elongated member 411B, and is also attached to the side 413C adjacent to the end 419C of the elongated member 411C.

The tubular members of the present disclosure may then have a wide range of dimensions. For example, the elongated members may be about 2-12 inches (50-300 millimeters) in length, may be about 0.01-0.08 inches (0.25-2.0 millimeters) in width or height, and may be about 0.1-1.0 inches (2.5-25 millimeters) in thickness or depth. The helical member may also be about 0.1-1.0 inches (2.5-25 millimeters) in thickness or depth. Further, the elongated perforations may be about 0.001-0.04 inches (0.025-1.0 millimeters) width or height at the largest point of width, such as the center of the elongated perforations, and may have a radius formed at the ends of the elongated perforations of about 0.002-0.02 inches (0.051-0.51 millimeters). Those having ordinary skill in the art, though, will appreciate that the above dimensions are for exemplary purposes only, and that the present disclosure encompasses a wide range of dimensions when forming the tubular member. Accordingly, the dimensions of the tubular member, and any elements thereof, may depend upon the application of the tubular member, such as the size of the particulate matter being screened.

Further, as shown in the above embodiments, the elongated members generally have a uniform thickness, cross-section, and size. However, those having ordinary skill in the art will appreciate the present disclosure is not so limited. In one embodiment, one or more of the elongated members may have a thickness that varies along the length of the elongated member. In another embodiment, rather than having a rectangular cross-section, one or more of the elongated members may have a trapezoidal cross-section, an elliptical cross-section, a convex cross-section, or a concave cross-section. In yet another embodiment, rather than having substantially planar surfaces for the sides of the elongated members, the elongated members may have concave or convex surfaces. Accordingly, by changing any of these features of the elongated members, the shapes and sizes of the elongated perforations may also change, corresponding to the changes of the elongated members. The elongated members may also have sharp edges, or may also incorporate hydrodynamic contouring (such as by having an elliptical cross-section), which may facilitate the flow of the gases and fluids through the wall of the tubular member while restricting flow of any desired particulate matter. Furthermore, the elongated members may be pivoted about the axis of the tubular member to facilitate flow through the wall of the tubular member.

Figure 5:
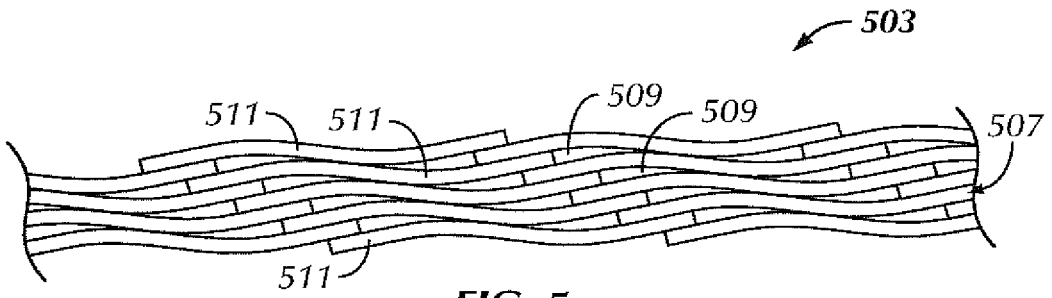
FIG. 5 shows another detail view of a compressed tubular member in accordance with embodiments of the present disclosure.

Referring now to FIG. 5, a detail view of a wall 507 of a tubular member 503 in accordance with embodiments disclosed herein is shown. In this embodiment, the tubular member 503 includes a plurality of elongated members 511 attached to each other with a plurality of elongated perforations 509 formed therebetween. This tubular member 503 has been compressed, as compared to the tubular member 303 shown in FIG. 3B, which is not compressed and is in a relaxed state.

Referring still to FIG. 5, the tubular member 503 has been compressed such that the diameter of the tubular member 503 has been decreased. When compressed, the elongated members 511 of the tubular member 503 may deform and the elongated perforations 509 between the elongated members 511 become narrower, at least in some areas. Specifically, when compressed, the elongated members 511 of the tubular member 503 may deform in a sinuous shape, as shown in FIG. 5, in which the portions of the elongated perforations become narrower from the interference of the elongated members 511. The sinuous shape of the elongated members 511, when deformed, may then create a local torsion within the wall 507 of the tubular member. Further, the elongated members 511 may deform such that portions of the elongated members 511 deform into the inner diameter of the tubular member 503 and/or out of the outer diameter of the tubular member 503. Preferably, the elongated members 511 are then only elastically deformed, or substantially elastically deformed, such that the tubular member 503 avoids plastic deformation. By compressing the tubular member 503 then, the wall 507 of the tubular member 503 may store expansive energy therein.

The tubular member 503 may then, for example, be inserted downhole into a wellbore, in which the tubular member 503 may be released. Upon being released, the expansive energy stored within the wall 507 of the tubular member 503 will enable the tubular member to expand back to a larger diameter than when inserted downhole. Preferably, the tubular member 503 expands back to near the original diameter before compression, only limited by the interior of the wellbore. However, because it is often difficult, if not impossible, to not lose any energy within the materials of the tubular member 503, the tubular member 503 may be limited to an expanded diameter larger than the compressed diameter, but still smaller than the original diameter before being compressed. Regardless, preferably when the tubular member 503 expands downhole, the tubular member 503 exerts an outward expansive force against the inside diameter of the wellbore (not shown).

As described above, the tubular member of the present disclosure may compress and expand, similar to a spring. Accordingly, also similar to a spring, the tubular member may have a spring constant, k, which is proportional to the force required to compress the tubular member. The higher the spring constant, k, of the tubular member, the more force is required to compress the tubular member. This compressive force may also be equal to the expansive force when the tubular member is allowed to expand. As such, the spring constant, k, of the tubular member may be designed into the tubular member, which is dependent upon several characteristics of the tubular member.

Figure 6:
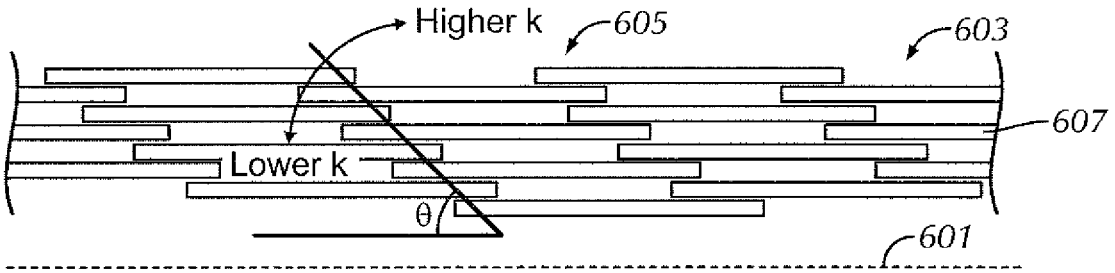
FIG. 6 shows a detail view of a tubular member in accordance with embodiments of the present disclosure.

For example, referring now to FIG. 6, a detail view of a tubular member 603 having multiple helical members 605 formed within a wall 607 in accordance with embodiments disclosed herein is shown. The helical members 605 are oriented within the wall 607 at an angle θ, in which θ defines the angle of the helical member 605 with respect to an axis 601 of the tubular member 603. As θ increases and the helical member 605 becomes more perpendicular with respect to the axis 601, the spring constant, k, of the tubular member 603 also increases. Similarly, as θ decreases and the helical member 605 becomes more parallel with respect to the axis 601, the spring constant, k, of the tubular member 603 also decreases. Table 1, shown below, shows multiple characteristics of tubular members of the present disclosure that may be varied to increase or decrease the spring constant k of the tubular members.

TABLE 1

| Tubular Members | Lower Spring Constant k | Higher Spring Constant k |
|---|---|---|
| Helical Member Angle | More Parallel with Axis | More Perpendicular with Axis |
| Helical Member Pitch | Higher Pitch | Lower Pitch |
| Elongated Member Length | Longer | Shorter |
| Elongated Member Width | Thinner | Wider |
| Elongated Member Thickness | Thinner | Thicker |
| Material Elasticity | More Elasticity | Less Elasticity |
| Material Yield Strength | Lower Yield Strength | Higher Yield Strength |
| Attachment Method of Elongated Members | Adhesive | Join, Braze, Forge, Laser or Particle Deposit |

As shown above, specific characteristics of a tubular member may be considered when preparing and manufacturing the tubular member for each application. For example, when installing a tubular member in accordance with the present disclosure downhole into a wellbore that has a rigid self-supporting structure, the tubular member may only have to expand to the inner diameter of the wellbore without a substantial amount of pressure required to be exerted upon the wellbore by the tubular member. In such an embodiment, a tubular member with a lower spring constant k may be desired. On the other hand, when installing a tubular member in accordance with the present disclosure downhole into a wellbore that has a loose self-supporting structure, the tubular member may have to expand to the inner diameter of the wellbore and then exert a substantial amount of pressure upon the wellbore. By exerting this pressure upon the wellbore, the tubular member may prevent the wellbore from deteriorating, or possibly even collapsing. In such an embodiment, a tubular member with a higher spring constant, k, may be desired.

Figure 7:
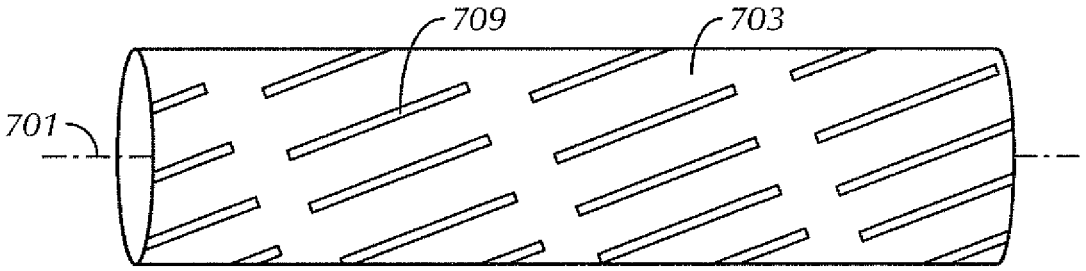
FIG. 7 shows a side view of a tubular member in accordance with embodiments of the present disclosure.

In the above embodiments, the tubular member of the present disclosure is shown to have the plurality of elongated members and the plurality of elongated perforations parallel with the axis of the wellbore. However, those having ordinary skill in the art will appreciate that the present disclosure is not so limited. For example, as shown in FIG. 7, a tubular member 703 may have a plurality of elongated perforations 709 aligned at an angle with respect to an axis 701 of the tubular member 703. Similarly, the elongated members (not shown) may also be aligned at an angle with respect to the axis 701 of the tubular member 703. As such, by increasing the angle between the elongated perforations and/or the elongated members with respect to the axis of the tubular member, the spring constant, k, of the tubular member may also increase.

Figure 8:
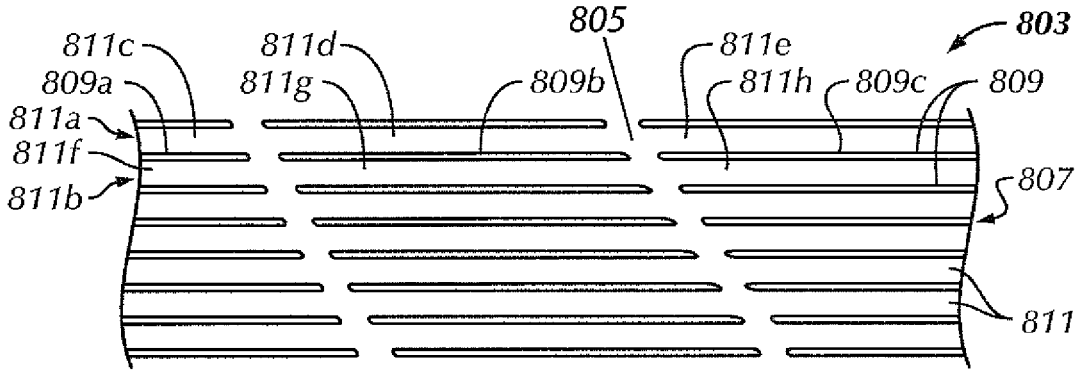
FIG. 8 shows a detail view of a tubular member in accordance with embodiments of the present disclosure.

Referring now to FIG. 8, a detail view of a wall 807 of a tubular member 803 in accordance with embodiments disclosed herein is shown. In this embodiment, the tubular member 803 includes a plurality of elongated members 811, a plurality of elongated perforations 809, and one or more helical members 805. Further, as shown, some of the plurality of elongated members 811 may be disposed in alignment with respect each other. For example, in FIG. 8, the elongated members 811C, 811D, 811E are disposed in alignment with respect to each other, and the elongated members 811F, 811G, 811H are disposed in alignment with respect to each other. On the other hand, the elongated members 311A, 311B shown in FIGS. 3A and 3B are not disposed in alignment with each other, and are instead disposed in a staggered arrangement with respect to each other. Further, in both FIGS. 3A, 3B, and 8, the plurality of elongated members 311, 811 are parallel with respect to each other.

Referring still to FIG. 8, the elongated members 811C, 811D, 811E may be formed integrally with each other such as to form a single elongated member 811A, or may be formed individually and attached to each other at the helical member 805. Similarly, the elongated members 811F, 811G, 811H may be formed integrally with each other such as to form a single elongated member 811B, or may be formed individually and attached to each other at the helical member 805. Preferably, the elongated members 811A, 811B are formed integrally with each other, in which this may facilitate manufacturing of the tubular member 803 (described more below).

These elongated members 811A, 811B may then be attached to the helical member 805, in which the helical member 805 may provide the attachment and interaction between the elongated members 811A, 811B. Further, the attachment between the helical member 805 and the elongated members 811A, 811B may define the size and shape of the elongated perforations 809 disposed therebetween. For example, as shown in FIG. 8, the elongated perforations 809 may have a length determined by the axial length provided between the helical members 805. Further, the elongated perforations 809 may have a width determined by the circumferential length provided between the attachment of the elongated members 811 with the helical members 805.

Furthermore, as described above, the elongated members 811C, 811D, 811E, may be disposed in alignment with each other, and the elongated members 811F, 811G, 811H may also be disposed in alignment with each other. As such, the elongated perforations 809 formed between the elongated members 811 may also be disposed in alignment with each other. For example, the elongated perforations 809A, 809B, 809C disposed between the elongated members 811C, 811D, 811E, 811F, 811G, 811H may be disposed in alignment with each other.

Figure 9:
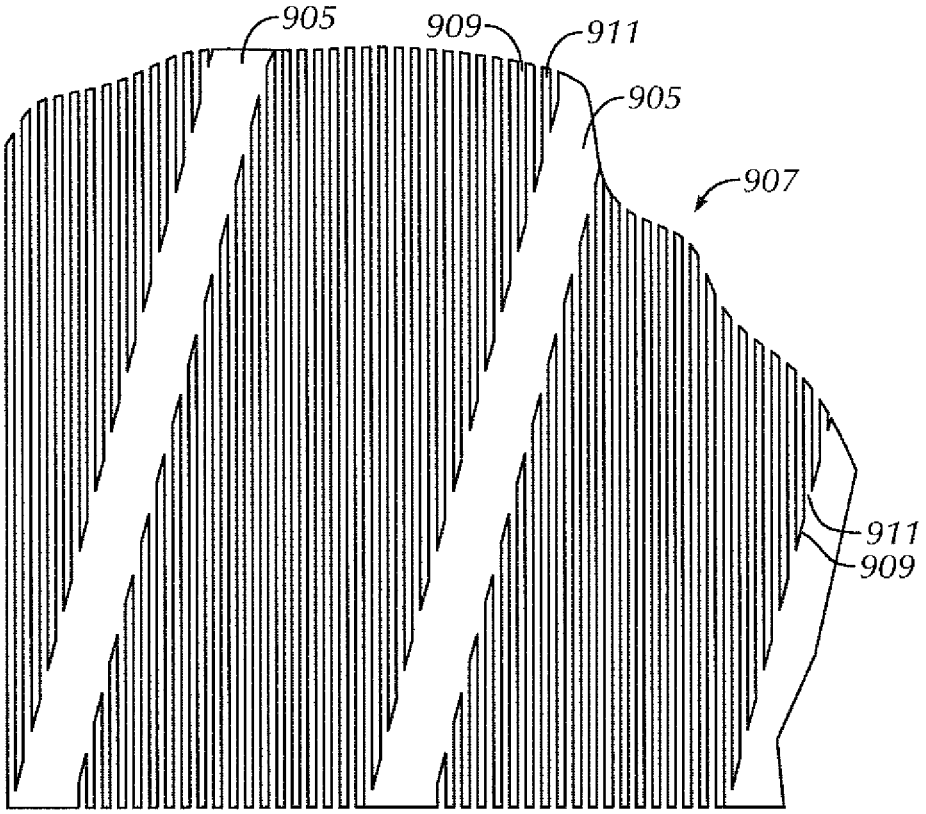
FIG. 9 shows a detail view of a tubular member in accordance with embodiments of the present disclosure.

Referring now to FIG. 9, a detail view of a wall 907 of a tubular member 903 in accordance with embodiments disclosed herein is shown. In this embodiment, the tubular member 903 includes a plurality of elongated members 911 attached to one or more helical members 905. Further, the elongated members 911 are attached to the helical members 905 such that a plurality of elongated perforations 909 are formed between the elongated members 911. As similar to the elongated members 811 shown in FIG. 8, some of the elongated members 911 may be disposed in alignment with respect to each other. In such an embodiment, the elongated perforations 909 disposed between the elongated perforations 909 may also be disposed in alignment with respect to each other.

Similar to the above embodiments shown, the tubular members 803, 903 shown in FIGS. 8 and 9, respectively, may be compressed such that the diameter of the tubular members 803, 903 decreases. As such, when compressed, the elongated members 811, 911 of the tubular members 803, 903 may deform and the elongated perforations 809, 909 between the elongated members 811, 911, respectively, become narrower, at least in some areas. By compressing the tubular members 803, 903, the wall 807, 907 of the tubular member 803, 903 may store expansive energy therein. This expansive energy may later be released from the tubular member 803, 903 such that the tubular member 803, 903 increases in diameter from the diameter that the tubular member 803, 903 was earlier compressed. This may be attained by elastically deforming the tubular member 803, 903, thereby reducing the amount of plastic deformation that the tubular member 803, 903 may be subject. Preferably, when tubular members of the present disclosure are compressed, the portion of the elongated perforations that is adjacent to the helical member does not deform. For example, whether the tubular member is in a compressed or expanded state, the portion of the elongated perforation adjacent to the helical member remains the same size and shape.

As described above, the tubular member of the present disclosure preferably elastically deforms such that when the tubular member is compressed to a smaller diameter, the tubular member may then expand to a larger diameter without any substantial deformation of the tubular member. However, in other embodiments, the tubular member may have a combination of elastic deformation with plastic deformation, or the tubular member may only substantially plastically deform. When the tubular member plastically deforms, the material of the tubular member may then yield. For example, in one embodiment, when the tubular member is compressed, the tubular member may substantially plastically deform, and have only minimal elastic deformation. As such, when the tubular member then expands, a mandrel may be used to plastically deform the tubular member to a larger diameter. Thus, the tubular member of the present disclosure may be used in an environment of elastic deformation, plastic deformation, or a combination of elastic and plastic deformation.

Figure 10A:
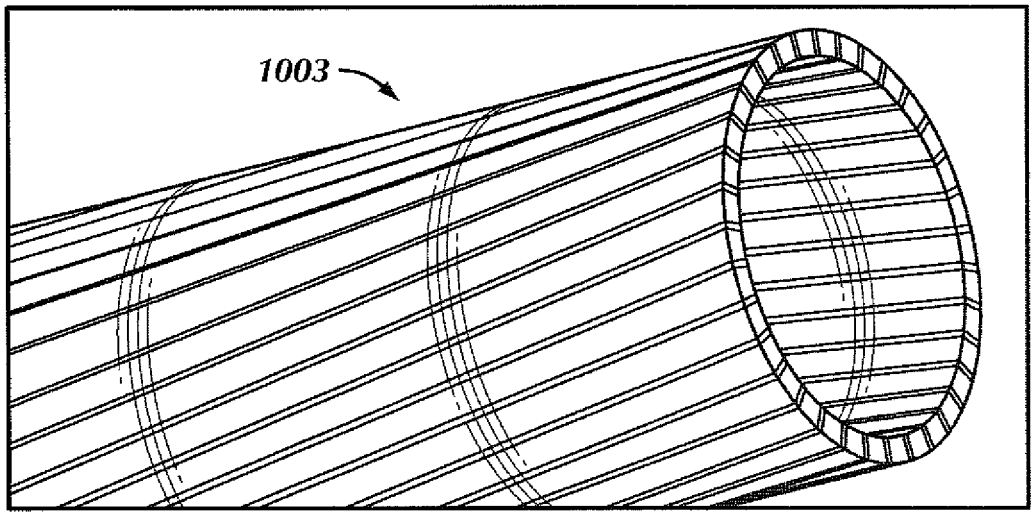
FIG. 10A shows a perspective view of a tubular member in accordance with embodiments of the present disclosure.
Figure 10B:
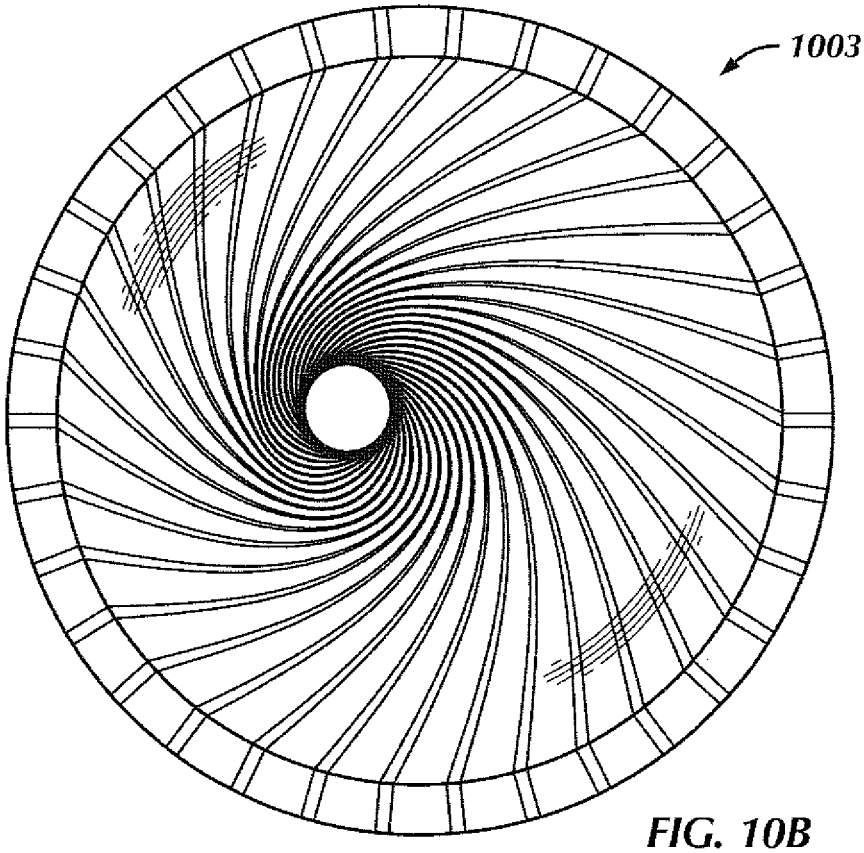
FIG. 10B shows another perspective view of the tubular member shown in FIG. 10A in accordance with embodiments of the present disclosure.
Figure 10C:
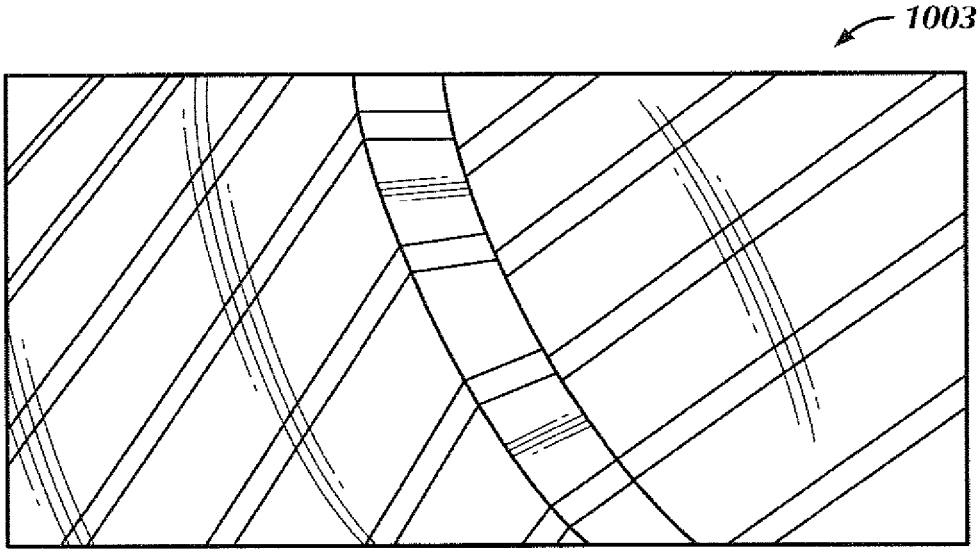
FIG. 10C shows another perspective view of the tubular member shown in FIG. 10A in accordance with embodiments of the present disclosure.

Referring now to FIGS. 10A-10C, perspective views of a tubular member 1003 in accordance with embodiments disclosed herein are shown. The tubular member 1003 includes a plurality of elongated members that are attached to each other. As such, a plurality of elongated perforations are formed between the elongated members, and a plurality of helical members are formed from the attachment of the plurality of elongated members to each other. FIG. 10A shows a perspective view of an end of the tubular member 1003, FIG. 10B shows a perspective view along an axis and through the inside of the tubular member 1003, and FIG. 10C shows an enlarged view of a end section of the tubular member 1003. Accordingly, FIGS. 10A-10C show the tubular member 1003 in a relaxed state, before the tubular member 1003 has been compressed.

As shown in FIGS. 10A-10C, the helical members may be solid such that the helical member extends from the inner diameter to the outer diameter of the tubular member. However, the present disclosure is not so limited, as the helical member may only extend through or contact only a portion of the tubular member. For example, in one embodiment, the helical member may be flush with one side of the tubular member, such as flush with the inner diameter of the tubular member, and the helical member may then only extend partially through the thickness of the tubular member. In such an embodiment, the helical member may then be recessed within the tubular member so as not to be flush with the outer diameter of the tubular member. In another embodiment, rather than being flush or recessed with the tubular member, the helical member may instead protrude from one side of the tubular member. Further, in yet another embodiment, the helical member may also be hollow. In such an embodiment, one or more portions of the helical member may then contact the inner diameter and/or the outer diameter of the tubular member. A hollow helical member (e.g., hollow spring member) may then be formed integrally with the tubular member, or may be later attached to the tubular member, such as by using attachment methods described below. Assuming the helical member is hollow then, the helical member may be used to transport materials and/or information downhole. For example, the helical member may have an electrical signal or a pulse transported therethrough, or fluids and/or other materials transported therethrough.

Furthermore, the helical member may have a constant pitch, or the helical member may have a variable pitch. For example, the pitch of the helical member along the tubular member may be constant so as to form a typical spiral, or the pitch of the helical member may vary such that helical member varies such that in some portions the helical member may be more parallel with the axis of the tubular member as compared to other portions of the helical member. Accordingly, those having ordinary skill in the art will appreciate that one or all of the above features may be combined when forming helical members within a tubular member in accordance with the present disclosure.

As shown and described in the above embodiments, the helical member may be formed in the wall in the tubular member and may be defined about the axis of the tubular member. Thus, the helical member may form a spiral about the tubular member in certain embodiments. Those having ordinary skill in the art, though, will appreciate that the present disclosure is not so limited, as the helical member is not limited to being defined about the axis of the tubular member. In another embodiment, the helical member may instead curve in one or more alternating directions when formed within the wall of the tubular member. For example, the helical member may have a sinuous shape, in which a helical member may curve back-and-forth in alternating directions along one side of the tubular member. Further, these features may be combined, in which the helical member may be both defined about the axis of the tubular member and alternate in directions along the tubular member.

When manufacturing a tubular member having a plurality of elongated members, the elongated members may first be placed within a fastening device, such as a jig. This fastening device may hold the elongated members in a desired arrangement, such as by having the plurality of elongated members disposed parallel with respect to each other. To facilitate obtaining the desired arrangement of the elongated members, space holders may be placed between the elongated members. After manufacturing, these space holders may be removed (e.g., chemically removed, mechanically removed, thermally removed, electrically removed, or magnetically removed), in which the void left by the space holders may form at least a portion of the elongated perforations.

After obtaining the desired arrangement, the elongated members may be attached to each other, such as by joining, by brazing, by applying an adhesive material, by using attachment members (e.g., mechanical snaps), by using pressure methods to attach the elongated members, or by a method known in the art. The elongated members may be attached (e.g., welded) to each other on one side, or on both sides of the elongated members. If attached to each other on both sides, the elongated members may be reversed or flipped within the fastening device so as to join, braze, or apply the adhesive material to the opposite side of the elongated members also.

Once the elongated members are attached to each other, thereby forming at least a portion of the wall of the tubular member, this portion of the tubular member may be substantially flat. In such an embodiment, the portion of the tubular member may be placed within a mechanical bending machine that curves the portion of the tubular member. One common type of mechanical bending machine is a roll bending machine that generally incorporates three or more rollers. These rollers may be adjusted such that as the portion of the tubular member is passed through the mechanical bending machine, only a minimal amount of curvature is formed within the portion of the tubular member. The portion of the tubular member may then be passed through the mechanical bending machine multiple times until the desired curvature is reached. For example, if a desired curvature of about 180 degrees is obtained, then two similar portions of the tubular member may be manufactured by the above-mentioned method, in which the two similar portions of the tubular member may be attached to each other afterwards to create an entire tubular member. Further, if a portion of a tubular member is formed with a curvature of more than about 180 degrees, a corresponding portion of the tubular member may be formed to combine with the other tubular member portion so as to create an entire tubular member. In other embodiments, both axial and radial bending may be incorporated into a tubular member of the present disclosure, depending on the application of the tubular member. However, those having ordinary skill in the art will appreciate that other types of methods may be used to form tubular members of the present application.

In one example, referring back to FIG. 8, the elongated members 811C, 811D, 811E may be in alignment with respect to each other and integrally formed such as to form elongated member 811A, and the elongated members 811F, 811G, 811H may be in alignment with respect to each other and integrally formed such as to form elongated member 811B. These elongated members 811A, 811B may then be disposed parallel with respect to each other, and the helical member 805 may be formed. For example, the elongated members 811A, 811B may be attached to each other, in which the attachment of the elongated members 811A, 811B may form the helical member 805. Though multiple methods may be used to create the helical member 805, one way may be to join the elongated members 811A, 811B to each other, in which the joining material (e.g., welding material) may create the helical member 805.

In other embodiments of the present disclosure, multiple other methods may be used when manufacturing a tubular member having a plurality of elongated members with a plurality of elongated perforations disposed therebetween. In one embodiment, particle deposition may be used, such as by depositing particles to form a portion or all of the helical members. Particle deposition may include one or more different methods, or a combination of different methods. For example, particle deposition may include high-energy density deposition, such as by using a beam to deposit particles. This may include laser deposition, electron deposition, plasma deposition, or any other high-energy density method known in the art. The particle deposited may then in the form of a solid, liquid, or gas, such as a powder, plasma, or vapor. Particle deposition may be more accurate and easier to control, as compared to typical joining and brazing methods. In another embodiment, particle deposition may be used, such as using particle deposited metal, to form a portion or all of a tubular member. For example, an entire tubular member in accordance with the present disclosure may be formed using particle deposition, or just portions, such as the helical member, or portions of the helical member, may be formed using particle deposition. Further, in another embodiment, a cutting tool (examples given above) may be used to form a portion or all of a tubular member. For example, a cutting tool may be used to form at least one perforation within the tubular member, or may be used to enlarge at least one perforation within the tubular member.

Further, to facilitate manufacturing of the tubular member, a groove may be formed within one or more of the elongated members, such as prior to forming the helical member. For example, during manufacturing, a plurality of elongated members may be aligned prior to forming the helical member and/or attaching the elongated members to each other with the helical member. A groove may be formed along the edges of the elongated members in a location where at least portion of the helical member is to be located. The groove may be formed during the manufacturing the elongated members, such as when the elongated members are shaped, or the groove may be formed into the elongated members, such as by cutting or milling the groove into the edges of the elongated members. Further, other methods known in the art may be used to form the groove into the elongated members, such as by using high-energy methods (e.g., laser) without departing from the scope of the present application.

Regardless, material, such as metal, may then be deposited in this groove, such as by joining, brazing, or laser deposition, in which the material deposited in the groove will form the helical member. Further, the groove may facilitate penetration of the deposited material within the tubular member. This may enable the deposited material to form a helical member with a larger radial thickness. Furthermore, rather than depositing material within groove, a pre-manufactured helical member may instead be placed into the groove. For example, a spring, or a plurality of springs, may be disposed within the groove formed within the elongated members. These springs may then be attached to the elongated members by conventional attachment or bonding methods, such as brazing, forging, joining, adhering, or other similar methods known in the art.

In another embodiment, the tubular member of the present disclosure may also have a coating applied thereto during manufacturing. As described above, a coating may be applied to a tubular member to enhance the mechanical properties of the tubular member. Further, a tubular member may have a coating applied thereto to control the size of the elongated perforations. For example, in an embodiment in which the elongated perforations of a tubular member are too large, a coating may be applied thereto. This coating may be used to decrease the size of the elongated perforations to a desired size.

Furthermore, in other embodiments, multiple helical members may be disposed adjacent to each other, such as in a side-by-side arrangement. In such an embodiment, the helical members may then contact each other, or at least portion of the helical members may contact each other. This arrangement of multiple helical members adjacent to each other, at least in some portions, may be used to increase the spring constant of the tubular member.

After compressing the tubular member of the present disclosure, and before disposing the tubular member downhole within a wellbore, the tubular member may be retained in the compressed state with a retaining device. A retaining device may include a band, sleeve, or windings disposed about the outside diameter of the tubular member, may include joints, tack welds, solder, or epoxy attached to the tubular member, may include removable, shearable, or deformable bands, coatings, or layers disposed about the outside of the tubular member, may include a chemical adhesive attached to the tubular member, or may include any other retaining device known in the art. These retaining devices may retain the expansive energy within the tubular member.

Then, once downhole and at the desired location, the retaining device may be released such that the expansive energy of the wall expands the tubular member to a larger diameter. This may be done by dissolving, disintegrating, shearing, deforming, or removing the exterior sleeve, bands, or coatings disposed about the outside diameter of the tubular member, or by rupturing or dissolving the joints, welds, solder, epoxy, or chemical adhesive disposed on the tubular member. In other embodiments though, a mechanical device, such as a mandrel or a cone described above, may still be used to expand the tubular member. In such an embodiment, the expansive energy of the tubular member may be used in combination with the expansive energy of the mechanical device. By increasing the expansive energy of the tubular member with the mechanical device, the tubular member may be able to increase formation pressure of the expandable tubular downhole.

For example, in one embodiment, a sleeve may be disposed about at least a portion of the outside diameter of the tubular member. This sleeve may be formed from a heat reactive and/or a chemically reactive material. As such, when the sleeve is disposed about the tubular member, the sleeve may be cooled, for example, in which the sleeve may contract around the tubular member. Assuming the reaction within the sleeve is strong enough, the sleeve may even compress the tubular member to the desired diameter. As such, when the tubular member is placed downhole, the sleeve may be heated, in which the sleeve would expand, thereby allowing the tubular member to expand also.

Further, in another embodiment, an elastomeric material may be integrated into the use of the tubular member. For example, in one embodiment, an elastomeric material, or a sleeve having an elastomeric material may be disposed about the tubular member. This sleeve, or the elastomeric material, may then be used to isolate the environment inside the tubular member from the environment outside the tubular member. For example, in such an embodiment, the sleeve may be water impermeable, in which the sleeve may prevent water from transferring across or through the tubular member. Thus, in such an embodiment, the tubular member may be used to prevent water flow within the wellbore at the location of the tubular member.

Those having ordinary skill in the art will appreciate that a number of materials may be used to form a tubular member, or at least a portion of a tubular member, in accordance with the present disclosure. For example, both metallic and non-metallic materials may be used to form the tubular member. An example of some metallic materials that may be used are bi-metals or composite metals. An example of some non-metallic materials that may be used are fibrous materials, such as carbon fiber, ceramic, polymer (e.g., high-strength plastic), or composite materials. Further, those having ordinary skill in the art will appreciate that a combination of both metallic and non-metallic materials may be used for a tubular member of the present disclosure.

Furthermore, those having ordinary skill in the art that the tubular member of the present disclosure may be configured to couple with each other, or with any other tubular member known in the art. In one embodiment, the tubular member may include a threaded connection disposed upon at least one of the ends of the tubular member. This threaded connection may be formed upon the end of the tubular member, may be added upon the tubular member, or may use any other method known in the art to dispose a threaded connection upon the end of the tubular. Further, other methods known in the art may be used to couple the tubular member, such as press-fitting, swaging, frictionally engaging, abutting (e.g., mechanical connecters, such as barbs, hooks, or fasteners, that couple one pipe with the other), elastic interference, without departing from the present disclosure. Furthermore still, the ends of the tubular member may be fixable, such as may be formed into a rigid structure. For example, the ends of the tubular member may be joined, welded, brazed, or use laser deposition, so as to prevent any collapsing of the ends of the tubular member. In such an embodiment, the ends of the tubular member may be configured to expand and compress with the tubular member, but the elongated members at the ends of the tubular member may then be fixed together, rather than being independently arranged. This may provide rigidity to the ends of the tubular member, thereby increasing the strength of the tubular member.

One or more of the tubular members formed in accordance with the present disclosure may provide for an expandable tubular having one or more of the following characteristics. The expandable tubular may have an expansion ratio of about at least 115%-180%, may have a particle size retention of about 25-250 microns (0.0001-0.0098 inches), may have a flexible formation contact of at least about 800-1000 psi (5520–6900 kPa), and may have a collapse rating of at least about 8000 psi (55,200 kPa).

Embodiments of the present disclosure may provide for one or more of the following advantages. First, the present disclosure may provide for an expandable tubular that is self-expanding, thereby eliminating the need for an additional tool that expands the expandable tubular. This may prevent the need for running additional tubular strings downhole to expand the expandable tubular, thereby increasing the efficiency of the wellbore operation. Next, the present disclosure may provide for an expandable tubular that may be recovered and reused. The tubular members described herein preferably elastically deform, rather than plastically deform (i.e., permanently deform). Therefore, when the tubular member is retrieved from one wellbore operation, it may be retrieved and reused within another wellbore operation. Further, the present disclosure may provide for an expandable tubular that may be customized for use in a variety of wellbore operations. By adjusting one or more characteristics of the expandable tubular, the spring constant of the expandable tubular may increase or decrease as desired.

Furthermore, the present disclosure may provide for an expandable tubular that produces a substantially consistent spring constant. Specifically, as the expandable tubular compresses and expands, the spring constant of the expandable tubular may stay substantially consistent. Finally, the present disclosure may provide for an expandable tubular that limits and/or controls variance in axial length during compression and expansion. For example, the elongated perforations and the elongated members disposed within the expandable tubular may control the axial length of the tubular member during compression and expansion. As such, as the expandable tubular compresses and expands, the axial length of the expandable tubular may stay substantially consistent, may elongate, or may shorten. Furthermore still, portions of the expandable tubular may be formed such that the portions of the expandable tubular respond differently during compression and expansion. For example, one portion of the expandable tubular may elongate during compression, whereas another portion of the expandable tubular may shorten during compression.

While the present disclosure has been described with respect to a limited number of embodiments, those skilled in the art, having benefit of this disclosure, will appreciate that other embodiments may be devised which do not depart from the scope of the disclosure as described herein. Accordingly, the scope of the disclosure should be limited only by the attached claims.

What is claimed is:

1. An expandable tubular to be used within geologic structures, comprising:

a substantially tubular shaped member having a first end and a second end and having an axis extending therethrough;

a wall of the tubular shaped member comprising a plurality of distinct elongated members extending from the first end of the tubular shaped member to the second end of the tubular shaped member, wherein each of the plurality of distinct elongated members is radially spaced from a next member of the plurality of distinct elongated members by a radial gap; and at least one helical member extending along the axis connecting the plurality of distinct elongated members to each other by at least one of an inner surface of the expandable tubular and an outer surface of the expandable tubular, wherein the tubular shaped member is configured to be compressed and store expansive energy within the wall of the tubular shaped member.

2. The expandable tubular of claim 1, wherein the radial gaps are substantially parallel with respect to each other.

3. The expandable tubular of claim 2, wherein the radial gaps are substantially parallel with the axis of the tubular shaped member.

4. The expandable tubular of claim 1, wherein each of the plurality of distinct elongated members is substantially parallel with respect to each other.

5. The expandable tubular of claim 1, wherein each of the plurality of distinct elongated members is substantially parallel with the axis of the tubular shaped member.

6. The expandable tubular of claim 1, wherein at least one of the plurality of distinct elongated members has one of a rectangular cross-section, a trapezoidal cross-section, a convex cross-section, and an elliptical cross-section.

7. The expandable tubular of claim 1, wherein at least one of the plurality of distinct elongated members has a substantially uniform thickness.

8. The expandable tubular of claim 1, wherein at least one of the plurality of distinct elongated members has one of a substantially planar surface, a substantially convex surface, and a substantially concave surface.

9. The expandable tubular of claim 1, wherein the plurality of distinct elongated members is connected using at least one of a brazing process, a joining process, a welding process, an adhesive material, a laser deposition process, a chemical deposition process, and a particle deposition process.

10. The expandable tubular of claim 1, wherein the at least one helical member comprises a plurality of helical members, wherein a pitch of each of the plurality of helical members is substantially the same.

11. The expandable tubular of claim 1, wherein the at least one helical member is defined about the axis of the tubular shaped member.

12. The expandable tubular of claim 1, wherein the at least one helical member curves in alternating directions along the wall of the tubular shaped member.

13. The expandable tubular of claim 1, further comprising a sleeve disposed about at least a portion of the tubular shaped member.

14. The expandable tubular of claim 13, wherein the sleeve comprises an elastomeric material.

15. The expandable tubular of claim 1, wherein an end of the tubular member is configured to couple with another tubular member.

16. The expandable tubular of claim 1, wherein a width of the radial gaps between each of the plurality of distinct elongated members and a next member of the plurality of distinct elongated members is constant.

17. The expandable tubular of claim 1, further comprising a second helical member extending along the axis connecting the plurality of elongated members to each other by the other of the inner surface of the expandable tubular and the outer surface of the expandable tubular.

18. The expandable tubular of claim 17, wherein the at least one helical member and the second helical member are aligned along at least a portion of a length of the tubular shaped member.

19. The expandable tubular of claim 18, wherein a helical gap is formed between the at least one helical member and the second helical member.

20. The expandable tubular of claim 19, further comprising a signal path along the helical gap formed between the at least one helical member and the second helical member.

21. The expandable tubular of claim 1, wherein the at least one helical member comprises a hollow tube.

22. The expandable tubular of claim 21, further comprising a signal path contained within the hollow tube.

23. An expandable tubular to be used within geologic structures, comprising:

a substantially tubular shaped member having a first end and a second end and having an axis extending therethrough, the tubular shaped member comprising:

a wall comprising a plurality of distinct elongated members extending from the first end of the tubular shaped member to the second end of the tubular shaped member, wherein each of the plurality of distinct elongated members is radially spaced from a next member of the plurality of distinct elongated members by a radial gap, and at least one helical member extending along the axis connecting the plurality of distinct elongated members to each other by at least one of an inner surface of the expandable tubular and an outer surface of the expandable tubular, wherein the tubular shaped member is configured to be compressed and store expansive energy within the plurality of elongated members of the tubular shaped member.

24. The expandable tubular of claim 23, wherein each of the plurality of distinct elongated members is substantially parallel with respect to each other, and wherein the plurality of distinct elongated members are substantially parallel with the axis of the tubular shaped member.

25. A method of expanding a tubular shaped member, the method comprising:

providing the tubular shaped member having a first diameter, a first and a second end, an axis extending therethrough, and a wall comprising a plurality of distinct elongated members extending from the first end of the tubular shaped member to the second end of the tubular shaped member, wherein each of the plurality of distinct elongated members is radially spaced from a next member of the plurality of distinct elongated members by a radial gap, wherein at least one helical member extends along the axis connecting the plurality of distinct elongated members to each other by at least one of an inner surface of the expandable tubular and an outer surface of the expandable tubular; and compressing the tubular shaped member to a second diameter that is smaller than the first diameter such that expansive energy is stored within the wall of the tubular shaped member.

26. The method of claim 25, wherein the tubular shaped member is selectively retained having the second diameter using a retaining device.

27. The method of claim 25, wherein the tubular shaped member is compressed such that the tubular shaped member elastically deforms between the first diameter and the second diameter.

28. The method of claim 25, further comprising:

disposing the tubular shaped member into a geologic structure in a compressed state; and releasing at least a portion of the expansive energy stored within the wall of the tubular shaped member such that the tubular shaped member expands to a third diameter that is larger than the second diameter.

29. The method of claim 25, wherein the plurality of elongated members has a sinuous shape after compressing the tubular shaped member.

30. An expandable tubular to be used within geologic structures, comprising:

a substantially tubular shaped member having an axis extending therethrough;

a wall of the tubular shaped member comprising a plurality of distinct elongated members extending from the first end of the tubular shaped member to the second end of the tubular shaped member, wherein each of the plurality of distinct elongated members is radially spaced from a next member of the plurality of distinct elongated members by a radial gap; and at least one helical member extending along the axis connecting the plurality of distinct elongated members to each other by at least one of an inner surface of the expandable tubular and an outer surface of the expandable tubular, wherein the at least one helical member is disposed in a groove formed along the plurality of distinct elongated members, wherein the tubular shaped member is configured to be compressed and store expansive energy within the wall of the tubular shaped member.

31. An expandable tubular to be used within geologic structures, comprising:

a substantially tubular shaped member having an axis extending therethrough;

a wall of the tubular shaped member comprising a plurality of distinct elongated members extending from the first end of the tubular shaped member to the second end of the tubular shaped member, wherein each of the plurality of distinct elongated members is radially spaced from a next member of the plurality of distinct elongated members by a radial gap;

at least one helical member extending along the axis connecting the plurality of distinct elongated members to each other by at least one of an inner surface of the expandable tubular and an outer surface of the expandable tubular, wherein the tubular shaped member is configured to be compressed and store expansive energy within the wall of the tubular shaped member, and wherein a surface area of the plurality of distinct elongated perforations is less than 90% of a surface area of the expandable tubular.

* * * * *